United States Patent [19]

Stepp et al.

[11] 4,449,237

[45] May 15, 1984

[54] AUDIO FEEDBACK SUPPRESSOR

[75] Inventors: Elvin D. Stepp, Cincinnati; Gary L. Claypoole, West Chester, both of Ohio

[73] Assignee: Cincinnati Electronics Corporation, Cincinnati, Ohio

[21] Appl. No.: 368,463

[22] Filed: Apr. 14, 1982

[51] Int. Cl.[3] ..... H04R 3/00

[52] U.S. Cl. ..... 381/93; 381/83

[58] Field of Search ..... 179/1 FS, 1 J, 1 P; 381/61, 62, 63, 64, 65, 71, 83, 93, 94; 331/78

[56] References Cited

U.S. PATENT DOCUMENTS 3,257,510 6/1966 Burkhard ..... 179/1 FS
3,681,708 8/1972 Olmstead ..... 331/78
4,039,753 8/1977 Balogh et al. ..... 179/1 FS
4,221,927 9/1980 Dankman et al. .
4,244,262 1/1981 Imai ..... 179/1 J X
4,354,415 10/1982 Sonnabend ..... 179/1 J X

*Primary Examiner*—A. D. Pellinen
*Assistant Examiner*—Keith E. George
*Attorney, Agent, or Firm*—Lowe, King, Price & Becker

[57] ABSTRACT

Positive feedback of an acoustic signal from a loud speaker to a microphone of a loud speaker system, i.e., howling, is prevented by randomly phase shifting an electric signal containing audio information supplied to the speaker. The random phase shifting is provided by variably delaying the electric signal in a serial analog register having a shift rate determined by an output signal of a pseudo random code generator.

26 Claims, 1 Drawing Figure

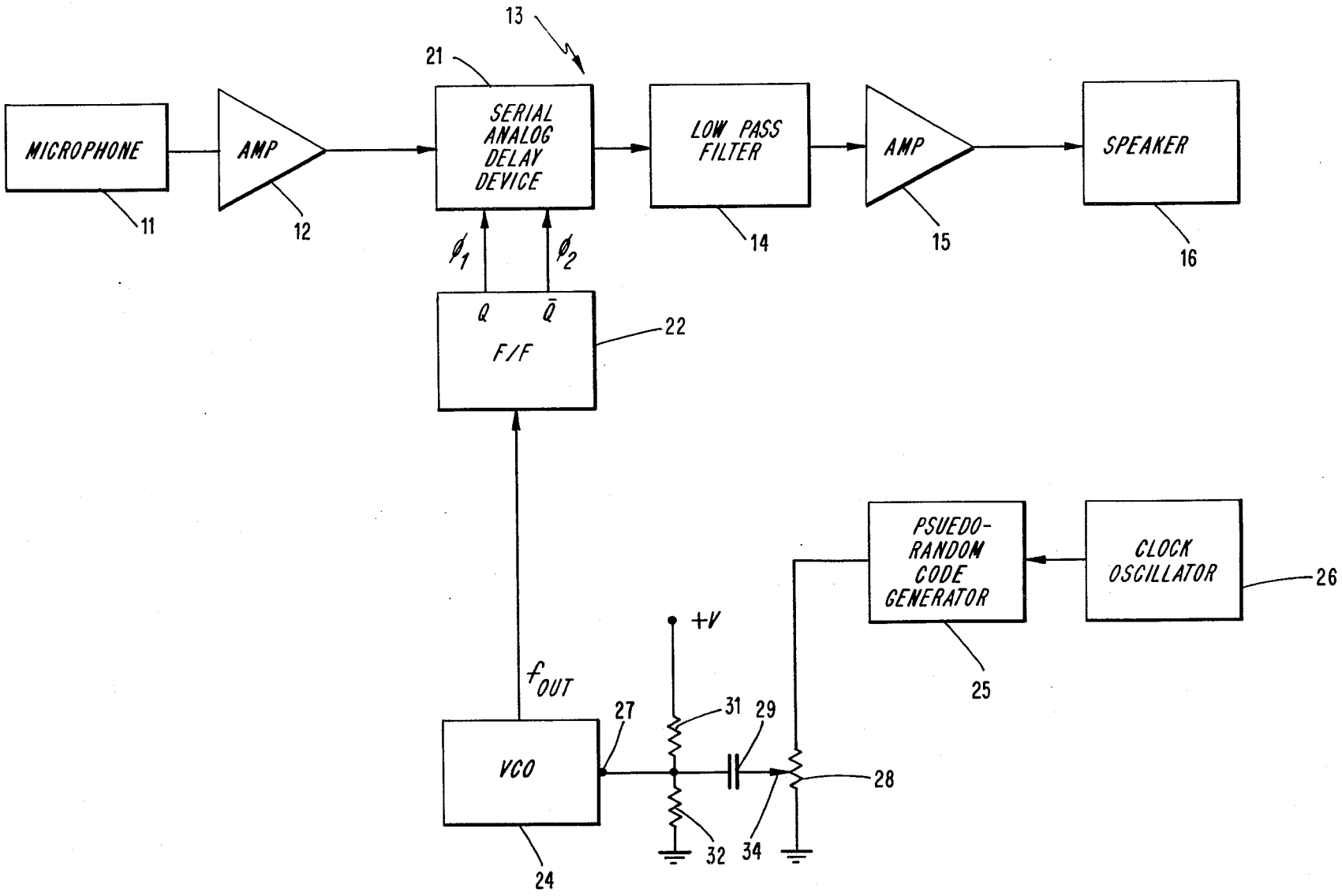
MICROPHONE
11
AMP
12
13
SERIAL ANALOG DELAY DEVICE
21
LOW PASS FILTER
14
AMP
15
SPEAKER
16
$\phi_1$
$\phi_2$
Q
$\bar{Q}$
F/F
22
$f_{OUT}$
VCO
24
27
+V
31
32
29
34
28
PSUEDO-RANDOM CODE GENERATOR
25
CLOCK OSCILLATOR
26

AUDIO FEEDBACK SUPPRESSOR

TECHNICAL FIELD

The present invention relates generally to an apparatus for preventing feedback of an acoustic signal from an electric-acoustic transducer to an acoustic-electric transducer, and more particularly, to such an apparatus wherein the phase of an acoustic signal derived from the electric-acoustic transducer is randomly shifted.

BACKGROUND ART

As well known, loud speaker systems are characterized by acoustic-electric transducers, e.g., microphones, which respond to an audio, acoustic signal to derive an electric signal that is supplied to an amplifier. The amplifier drives an electric-acoustic transducer, e.g., a loud speaker, which generates an acoustic signal that is an appropriate replica in frequency, phase and amplitude of the acoustic signal supplied to the acoustic-electric transducer. The electric-acoustic transducer is frequently positioned relative to the acoustic-electric transducer such that positive acoustic feedback occurs between them. The resulting positive feedback is quite objectionable and manifests itself as "howling", a phenomenon that has been frequently encountered in many loud speaker system situations.

Many different devices and techniques have been employed for suppressing acoustic positive feedback to prevent howling. Amongst these methods and techniques are noise cancelling and directional microphones, baffles, and acoustic delay lines. Each of these prior art structures and techniques has certain problems associated with it.

Noise cancelling and directional microphones are designed to limit the positive acoustical feedback energy which can be coupled from the electric-acoustic transducer to the acoustic-electric transducer. It has been found that these structures do not always provide adequate suppression of frequency and phase components which are coupled between the transducers. This structure provides only a limited margin from the positive acoustic feedback and therefore does not perform adequately in certain situations.

The baffles and sound absorbing barriers are placed in a region where the loud speaker system is located in such a manner as to attenuate residual acoustic energy which would otherwise ultimately be coupled back in phase to the acoustic-electric transducer to produce oscillation, resulting in howling. In many instances, baffles can not be used, have limited effect, and are cumbersome. In a portable loud speaker system, baffles are usually out of the question because the region where the loud speaker system is operating may be outdoors, or in an enclosed structure that is susceptible to many other uses. A further disadvantage of the baffles is that they are bulky and require spatial or physical positioning.

Acoustic delay lines employed to prevent howling delay an acoustic signal supplied to a microphone prior to the signal being transduced into an electric signal. The acoustic delay line thereby time delays the originally generated acoustic signal and the electric signal supplied by the acoustic-electric transducer to the loud speaker system amplifier. Thereby, the acoustic signal derived from the electric-acoustic acoustic transducer is phase displaced relative to the originally derived acoustic signal. It has been found that this apparatus and technique is not entirely successful in many cases because feedback between the two transducers translates the problem, causing the acoustic signal to still be fedback in phase to the acoustic-electric transducer. To enable the acoustic delay line to be completely effective requires time delays which may produce echo effects unacceptable to a speaker and/or listener. The echo effect occurs because the acoustic signal must be time delayed for an interval greater than the time required for acoustic energy components to be reflected from the loud speaker to the microphone.

It is, accordingly, an object of the present invention to provide a new and improved apparatus for preventing acoustic feedback i.e., howling, in loud speaker systems including acoustic-electric and electric-acoustic transducers.

Another object of the present invention is to provide a new and improved apparatus for preventing acoustic feedback in loud speaker systems wherein adequate suppression of acoustic feedback is provided with a relatively high margin from positive acoustic feedback.

Still another object of the invention is to provide an echo free apparatus for preventing acoustic feedback in loud speaker systems.

Still another object of the invention is to provide in-line electronic circuitry for preventing acoustic feedback in loud speaker systems.

An additional object of the invention is to provide a new and improved portable apparatus for preventing acoustic feedback in a loud speaker system, wherein the system is adaptable to any physical site, is not bulky and can be easily incorporated as a circuit component in connection with the loud speaker amplifier.

DISCLOSURE OF INVENTION

In accordance with the present invention, feedback to an acoustic to electric signal transducer of an acoustic signal derived from an electric to acoustic transducer is prevented by randomly shifting the phase of an electric input signal derived from the acoustic to electric signal transducer. The random phase shift is provided by variably delaying the electric input signal by an amount controlled by a noise source.

In the preferred embodiment, the noise source includes a pseudo random code generator and the delay means includes a register having plural cascaded stages. Shifting of signal components stored in the cascaded stages is controlled by the pseudo random source. The pseudo random noise source has a relatively high frequency relative to the transduced audio signal to control the shifting rate of signal samples in the cascaded stages of the delay line. Thereby, frequency components introduced by the pseudo random noise source are sufficiently high that they can not be heard by a human listener. The random phase shift is also not perceptible to a human listener.

The pseudo random noise source has the advantage of having controlled, but random, phase shifting effects. The controlled random phase shift positively prevents the derivation of noise components that can be heard by a human from the electric-acoustic transducer.

In the preferred embodiment, signals are shifted between stages of the delay line at a frequency in the twenty to fifty kiloHertz range in response to a pseudo random code generator having an output sequence of approximately $2^{15}-1$ bits. The generator is typically driven by a 100 kiloHertz oscillator, whereby the phase of the variable frequency oscillator is shifted several times during each cycle of the variable frequency oscillator.

It is, accordingly, still another object of the present invention to provide an apparatus for preventing feedback to an acoustic to electric signal transducer of an acoustic signal derived from an electric to acoustic transducer by randomly shifting the phase of an electric input signal by a predictable amount, to assure that noise introduced by the shifting process is not perceived by a listener.

The above and still further objects, features and advantages of the present invention will become apparent upon consideration of the following detailed description of the one specific embodiment thereof, especially when taken in conjunction with the accompanying drawings.

BRIEF DESCRIPTION OF THE DRAWING

The single FIGURE is a block diagram of a preferred embodiment of the invention.

BEST MODE FOR CARRYING OUT THE INVENTION

Reference is now made to the sole figure of the drawing wherein microphone 11, i.e., an acoustic to electric transducer, is responsive to an audio frequency, acoustic signal, such as a voice or music signal. Microphone 11 derives an electric signal that is an approximate replica of the acoustic signal. The electric signal derived by microphone 11 is applied to an input terminal of amplifier 12, typically a preamplifier having tone controls and serving as a buffer. Amplifier 12 derives an output signal that is generally a replica of the signal transduced by microphone 11.

The audio frequency, electric signal derived by amplifier 12 is applied to random phase shift device 13, which derives an output wave having frequency and amplitude components approximately the same as the output of amplifier 12, but with a phase that randomly varies, as a function of time, relative to the phase of the output of the amplifier. The random phase shift introduced by device 13 is generally performed by taking samples of the output signal of the amplifier and delaying each sample by a different, random amount. The random delay process is predictable and periodic over a relatively long time period.

The resulting randomly delayed, sampled signal derived from device 13 is smoothed by low pass filter 14, having a cut off frequency such that samples taken by device 13 are smoothed into a continuous wave, without affecting the audio frequency information content thereof. The resulting, audio frequency output signal of low pass filter 14 is applied to amplifier 15, a typical power amplifier, having an output which drives speaker 16, i.e., an electric to acoustic transducer. Amplifier 15 also isolates or buffers the power components therein and speaker 16 from the output terminal of low pass filter 14 and random delay device 13. Because of the phase disruption and the variable random phase shift imposed by the electrical circuitry including random phase shift device 13 on the acoustic output signal of speaker 16, positive acoustic feedback between the acoustic output of speaker 16 and the acoustic input to microphone is minimized. The ear of a person listening to speaker 16 is insensitive to the random phase shift introduced by device 13, particularly for voice signals, whereby the quality of acoustic speech signals derived from speaker 16 is minimally effected by the random phase shift.

In the preferred embodiment, the random, predictable and periodic phase shift introduced by device 13 on the output of amplifier 12 is provided by serial, analog delay device 21, preferably in the form of a charge coupled shift register having a storage capacity of 2048 bits. As is well known, charge coupled shift registers require two complementary square wave input signals, in this case derived from complementary Q and $\bar{Q}$ output signals applied by toggle flip-flop 22 to $\Phi_1$ and $\Phi_2$ input terminals of charge coupled shift register 21.

To provide the random delay of device 21, flip-flop 22 has a clock input terminal responsive to a randomly variable output frequency $f_{out}$ of voltage controlled oscillator 24. Output frequency $f_{out}$ of oscillator 24 is predictably random, in a periodic manner about a predetermined center frequency. In the preferred embodiment, center frequency of oscillator 24 can be set anywhere between 20 KHz and 50 KHz.

To control the variable frequency output of oscillator 24, pseudo-random code generator 25 is provided. Pseudo-random code generator 25 is driven by clock oscillator 26 to derive a sequence of bilevel pulses having pseudo-randomly occurring transition time, determined by the internal circuitry of the code generator, as well known. In the preferred embodiment, clock oscillator 26 has a frequency of 100 KHz, while generator 25 derives a pseudo-random pulse sequence having a length of $2^{15}-1$ bits, whereby the sequence derived from generator 25 repeats itself approximately once every third of a second. A sequence of $2^{15}-1$ is employed because the frequency components are sufficiently noise-like, when imposed on the frequency of oscillator 24 and the analog signal coupled through variable phase delay device 21. For a clock frequency of 100 kHz, pseudo noise code sequences with fewer than $2^{15}-1$ bits have repetition rates such that audible frequency tones are likely to be heard in the acoustic signal derived from speaker 16. Of course, such audible frequency tones are undesirable because they are perceived by persons listening to speaker 16.

The output signal of pseudo-random code generator 25 is applied to input terminal 27 of voltage controlled oscillator 24 by way of a network including potentiometer 28, series capacitor 29, and a resistive voltage divider including resistors 31 and 32, for the d.c. voltage tv. The d.c. voltage tv, in combination with resistors 31 and 32, determines the center frequency of the output derived from voltage controlled oscillator 24, by virtue of a connection between a common terminal for the resistors to input terminal 27 of oscillator 24.

Each positive and negative going transition derived from pseudo-random code generator 25 results in discrete phase changes of the same extent in first and second directions in the output of voltage controlled oscillator 24, respectively. Because there is a like number of positive and negative going transitions in each sequence derived from generator 25, the output of oscillator 24 always varies, on a long term basis, about the center frequency determined by the d.c. voltage supplied to terminal 27 by the voltage divider including resistors 31 and 32 responsive to the d.c. voltage tv.

To provide the equal and opposite phase changes resulting from each positive and negative transition in the output of generator 25, the output of the generator is applied across potentiometer 28, having a slider 34 which determines the amplitude of the discrete phase changes. Capacitor 29 is connected between slider 34 and input terminal 27 of oscillator 24, whereby the positive and negative going transitions in the pseudo-random sequence derived from generator 25 are respectively converted into positive and negative pulses having a zero average value. Because the pulses coupled through capacitor 29 have a zero average value they do not effect the center frequency of oscillator 24 over a long term basis.

While there has been described and illustrated one specific embodiment of the invention, it will be clear that variations in the details of the embodiment specifically illustrated and described may be made without departing from the true spirit and scope of the invention as defined in the appended claims.

We claim:

1. Apparatus for minimizing feedback to an acoustic to electric signal transducer of an acoustic signal derived from an electric to acoustic transducer comprising means responsive to an electric input signal derived from the acoustic to electric transducer for randomly shifting the phase of the electric input signal by an amount independent of any characteristic of the input signal to derive an electric audio signal having a phase randomly shifted relative to the phase of the input signal, and means responsive to the phase shifted electric audio signal for supplying the phase shifted electric audio signal to the electric to acoustic transducer.

2. The apparatus of claim 1 wherein the random phase shifting means includes means for variably delaying the electric input signal such that frequency components of the acoustic signal derived from the electric to acoustic transducer introduced by the variable phase shift of the delay means can not be heard by a human.

3. The apparatus of claim 1 wherein the random phase shifting means includes a noise source independent of the input signal, and delay means for variably delaying the electric signal in response to the noise source.

4. The apparatus of claim 3 wherein the delay means includes a plurality of cascaded stages, and means responsive to the noise source for randomly controlling the time when samples of the electric input signal are shifted between the cascaded stages.

5. The apparatus of claim 1 wherein the random phase shifting means includes a noise source, and delay means for variably delaying the electric signal in response to the noise source, the delay means including a variable frequency oscillator having an output frequency controlled by the noise source.

6. The apparatus of claim 1 wherein the random phase shifting means includes a noise source, and delay means for variably delaying the electric signal in response to the noise source, the delay means including a variable frequency oscillator having an output frequency controlled by the noise source, the noise source including a pseudo-random code generator driven at a predetermined frequency.

7. In combination, acoustic-electric transducer means for deriving an audio, information bearing electric signal, means responsive to the electric signal for randomly shifting the phase of the electric signal by an amount independent of any characteristic of the information bearing electric signal, and an electric-acoustic transducer responsive to the randomly phase shifted electric signal, whereby the transducer derives an acoustic information signal that is not susceptible to acoustic feedback oscillations.

8. The apparatus of claim 7 wherein the random phase shifting means includes a noise source independent of the input signal, and delay means for variably delaying the electric signal in response to the noise source.

9. The apparatus of claim 7 wherein the noise source includes a pseudo-random code generator.

10. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator.

11. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator driven at a predetermined frequency.

12. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator driven at a predetermined frequency, the predetermined frequency and the code generator deriving a sequence such that frequency components of the acoustic signal derived from the electric to acoustic transducer introduced by the variable phase shift of the delay means can not be heard by a human.

13. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator for deriving a sequence of approximately at least $2^{15}-1$ bits at a predetermined frequency of approximately at least 100 KHz such that frequency components of the acoustic signal derived from the electric to acoustic transducer introduced by the variable phase shift of the delay means can not be heard by a human.

14. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator for deriving a sequence of first and second polarity, equal amplitude pulses having a zero average amplitude and pseudorandom occurrence times, said pulses being applied to a control input terminal of the oscillator so that in response to the first and second polarity pulses equal and opposite phase changes respectively occur in the output of the oscillator controlling the delay means.

15. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator driven at a predetermined frequency, the noise source including means responsive to the pseudo-random code generator for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means.

16. The apparatus of claim 7 wherein the random phase shifting means includes a noise source, and delay means for variably delaying the electric signal in response to the noise source, the delay means including a variable frequency oscillator having an output frequency controlled by the noise source, the noise source including a pseudo-random code generator driven at a predetermined frequency, the noise source including means responsive to the pseudo-random code generator for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means, the predetermined frequency and the code generator deriving a sequence such that frequency components of the acoustic signal derived from the electric to acoustic transducer introduced by the variable phase shift of the delay means can not be heard by a human.

17. The apparatus of claim 7 wherein the random phase shifting means includes a noise source, and delay means for variably delaying the electric signal in response tol the noise source, the delay means including a variable frequency oscillator having an output frequency controlled by the noise source, the noise source including a pseudo-random code generator driven at a predetermined frequency, the noise source including means responsive to the pseudo-random code generator for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means, the pseudo-random code generator deriving a sequence of approximately at least $2^{15}-1$ bits at a predetermined frequency of approximately at least 100 KHz such that frequency components of the acoustic signal derived from the electric to acoustic transducer introduced by the variable phase shift of the delay means can not be heard by a human.

18. Apparatus for minimizing feedback to an acoustic to electric signal transducer of an acoustic signal derived from an electric to acoustic transducer comprising means responsive to an electric input signal derived from the acoustic to electric transducer for randomly shifting the phase of the electric input signal to derive an electric audio signal having a phase randomly shifted relative to the phase of the input signal, and means responsive to the phase shifted electric audio signal for supplying the phase shifted electric audio signal to the electric to acoustic transducer, the random phase shifting means including a noise source having a pseudo-random code generator, and delay means for variably delaying the electric signal in response to the noise source.

19. Apparatus for minimizing feedback to an acoustic to electric signal transducer of an acoustic signal derived from an electric to acoustic transducer comprising means responsive to an electric input signal derived from the acoustic to electric transducer for randomly shifting the phase of the electric input signal to derive an electric audio signal having a phase randomly shifted relative to the phase shifted electric audio signal for supplying the phase shifted electric audio signal to the electric to acoustic transducer, the random phase shifting means includes a noise source having a pseudorandom code generator, and delay means for variably delaying the electric signal in response to the noise source, the delay means including a variable frequency oscillator having an output frequency controlled by the noise source.

20. The apparatus of claim 19 further including means for driving the pseudo-random generator at a predetermined frequency.

21. The apparatus of claim 19 further including means for driving the pseudo-random code generator at a predetermined frequency, the predetermined frequency and the code generator deriving a sequence of control pulses such that frequency components of the acoustic signal derived from the electric to acoustic transducer introduced by the variable phase shift of the delay means can not be heard by a human.

22. The apparatus of claim 19 wherein the pseudo-random code generator includes means for deriving a sequence of approximately at least $2^{15}-1$ bits at a predetermined frequency of approximately at least 100 KHz such that frequency components of the acoustic signal derived from the electric to acoustic transducer introduced by the variable phase shift of the delay means can not be heard by a human.

23. The apparatus of claim 22 wherein the pseudo-random code generator includes means for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means.

24. The apparatus of claim 19 wherein the pseudo-random code generator includes means for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means.

25. The apparatus of claim 19 further including a predetermined frequency source for driving the pseudo-random code generator.

26. The apparatus of claim 19 further including a predetermined frequency source for driving the pseudo-random code generator, the noise source including means responsive to the pseudo-random code generator for deriving a sequence of first and second polarity, equal amplitude pulses having a zero average amplitude and pseudo-random occurrence times, said pulses being applied to a control input terminal of the oscillator so that in response to the first and second polarity pulses equal and opposite phase changes respectively occur in the output of the oscillator controlling the delay means, the pseudo-random code generator deriving a sequence of approximately at least $2^{15}-1$ bits at a predetermined frequency of approximately at least 100 KHz such that frequency components of the acoustic signal derived from the electric to acoustic transducer introduced by the variable phase shift of the delay means can not be heard by a human.

* * * * *